United States Patent [19]

Shacket et al.

[11] Patent Number: 4,631,893

[45] Date of Patent: Dec. 30, 1986

[54] SINGLE STORY HOUSE ADDITION STRUCTURE AND METHOD

[75] Inventors: Sheldon Shacket, Southfield; Robert Helfman, Franklin, both of Mich.

[73] Assignee: Trus-Us Inc., Royal Oak, Mich.

[21] Appl. No.: 639,789

[22] Filed: Aug. 13, 1984

Related U.S. Application Data

[63] Continuation-in-part of Ser. No. 580,134, Feb. 14, 1984, Pat. No. 4,480,420, which is a continuation of Ser. No. 461,024, Jan. 26, 1983, Pat. No. 4,449,334, which is a continuation-in-part of Ser. No. 430,854, Sep. 30, 1982.

[51] Int. Cl.[4] ..... E04G 21/00

[52] U.S. Cl. ..... 52/745; 52/79.2; 52/79.3

[58] Field of Search ..... 52/79.2, 79.3, 79.7, 52/747, 745, 748

[56] References Cited

U.S. PATENT DOCUMENTS

| | | | |
|---|---|---|---|
| 2,154,142 | 4/1939 | Whelan | 52/79.3 |
| 2,980,968 | 4/1961 | Jones | 52/745 |
| 3,089,201 | 5/1963 | Helfman | 52/90 |
| 3,422,582 | 1/1969 | VanDerLely | 52/79.3 |
| 3,629,983 | 12/1971 | Tenn | 52/79.3 |
| 3,722,171 | 3/1973 | Godley | 52/90 |
| 3,965,624 | 6/1976 | Madonna | 52/28 |
| 3,990,197 | 11/1976 | Johnson | 52/125.2 |
| 4,003,182 | 1/1977 | Wokas | 52/745 |
| 4,005,556 | 2/1977 | Tuomi | 52/745 |
| 4,050,215 | 9/1977 | Fisher | 52/79.3 |
| 4,449,334 | 5/1984 | Shacket | 52/79.3 |
| 4,480,420 | 11/1984 | Shacket | 52/79.3 |

FOREIGN PATENT DOCUMENTS

| | | | |
|---|---|---|---|
| 2411283 | 8/1979 | France | 52/90 |
| 1209785 | 10/1970 | United Kingdom | 52/79.1 |
| 1433385 | 4/1976 | United Kingdom | 52/90 |

OTHER PUBLICATIONS

Home Plan Portfollio, ©Home Planners Inc., 1972, Design A 1978.

Home Planners 230 Homes by Richard B. Pollman, ©Home Planners Inc., 1974, pp. 44, 80, 120, 123, 181.

*Primary Examiner*—Henry E. Raduazo

*Attorney, Agent, or Firm*—Dale R. Small & Associates

[57] ABSTRACT

The building structure comprises a pre-existing single house structure having a peaked roof with an opening therein, a separate later built prefabricated dwelling unit positioned in the opening in the peaked roof of the house structure and extending outwardly away from the house structure and supported in the opening in the house structure by bearing walls of the house structure or separate support structure or by both which dwelling unit includes access either from the exterior or interior of the house structure or both, and which prefabricated dwelling unit includes parallel spaced apart side walls including a truss therein extending the full length of the side walls. Expansion of the single story pre-existing house structure is accomplished by constructing a prefabricated dwelling unit at a remote location shipping the dwelling unit to the site of the house structure, cutting an opening in the roof of the house structure placing additional support structure for the dwelling unit inside or outside of the house structure in either spaced relation to, adjacent or within bearing walls of the house structure, physically lifting the prefabricated dwelling unit into position in the opening in the peaked roof of the house structure and extending outwardly therefrom and supporting the prefabricated dwelling unit on one or more of the bearing walls of the house structure and the separate support structure.

9 Claims, 6 Drawing Figures

SINGLE STORY HOUSE ADDITION STRUCTURE AND METHOD

CROSS REFERENCE TO RELATED APPLICATIONS

This application is a continuation-in-part of patent application Ser. No. 580,134, filed Feb. 14, 1984 and now U.S. Pat. No. 4,480,420 which is a continuation of patent application Ser. No. 461,024, filed Jan. 26, 1983, now U.S. Pat. No. 4,449,334 issued May 22, 1984 which is a continuation-in-part of patent application Ser. No. 430,854 filed Sept. 30, 1982.

BACKGROUND OF THE INVENTION

1. Field of the Invention

The invention relates to expansion of pre-existing single story house structures having peaked roofs and refers more specifically to a method of expanding a pre-existing single story house structure having peaked roof structure comprising cutting an opening in the roof, manufacturing a prefabricated later built room size dwelling unit at a remote location shippping the prefabricated dwelling unit to the pre-existing single story house structure, lifting the prefabricated dwelling unit into the opening in the roof structure of the pre-existing house structure and supporting the prefabricated dwelling unit on bearing walls of the pre-existing house structure or any other substitute for a bearing wall such as posts, beams, cross beams or stanchions positioned within the pre-existing house structures or in spaced relation thereto and providing access to the prefabricated dwelling unit from the exterior and/or interior of the pre-existing house structure and the resulting structure.

2. Description of the Prior Art

In the past, existing single story house structure including a peaked roof have sometimes been expanded by cutting an opening in the peaked roof and constructing in the opening a room sized dwelling unit accessible from within the existing house structure. The added dwelling unit has in the past been built from individual pieces of lumber, sheeting and other building materials carried to the opening in the roof manually on ladders and the like. The added dwelling units have in the past been supported from the existing house structure through bearing walls and the like. One such house addition is specifically shown in U.S. Pat. No. 3,089,201.

Such building structure and method of construction have numerous draw backs. Thus, for example, the added dwelling unit is limited to the dimensions of the existing roof structure also the weight of the added dwelling unit is limited to that weight which the existing building structure will support. In some areas, local building codes prohibit the building of such added dwelling units entirely due to fear of earthquake stresses on the supporting structure of the existing house structure.

Also such method of expanding an existing single house structure requires a considerable period of time as for example two or three months during which the roof of the existing house structure is open while the added dwelling unit is being constructed in the opening. There is therefore considerable chance of rain damage to the existing house structure while the roof is open. Further during cold weather in the northern regions, opening of the roof structure of an existing house structure may not be bearable in that it may cause freezing damage within the existing house structure and/or make the existing house structure uninhabitable while the dwelling unit addition is constructed.

SUMMARY OF THE INVENTION

In accordance with the method of the invention an opening for a room sized dwelling unit is cut in the roof of a pre-existing single story house structure having a peaked roof, a later built, prefabricated room sized dwelling unit is constructed at a remote location and shipped to the pre-existing house structure, additional support structure for supporting the prefabricated dwelling unit is provided in or adjacent the pre-existing house structure and the prefabricated dwelling unit is lifted into position in the oepning in the pre-existing house structure and is supported within the opening to provide the structure of the invention.

In accordance with the structure of the invention, the prefabricated dwelling unit may extend outward away from the pre-existing house structure and the means for supporting the prefabricated dwelling unit may be bearing walls of the pre-existing house structure or may be any substitute therefore such as beams, columns, stanchions, or the like constructed inside or outside of the pre-existing house structure or in the pre-existing bearing walls thereof. Structure for ingress and egress to and from the prefabricated dwelling unit from the outside or inside of the pre-existing dwelling structure may be part of the structure of the invention.

In addition, the prefabricated building unit of the invention includes at least one pair of parallel spaced apart walls having trusses extending the entire length thereof which support the prefabricated building unit and means for maintaining the parallel side walls in spaced apart relation.

Also, while the prefabricated dwelling unit is preferably lifted into place as a single unit, it is contemplated within the scope of the present invention to prefabricate the floor panel, wall panels and roof separately and lift them into place and connect them within the opening in the existing roof structure separately. Further, the roof structure may be lifted into place and secured together as separate trusses and covering panels.

DESCRIPTION OF THE PREFERRED EMBODIMENT

Figure 1:
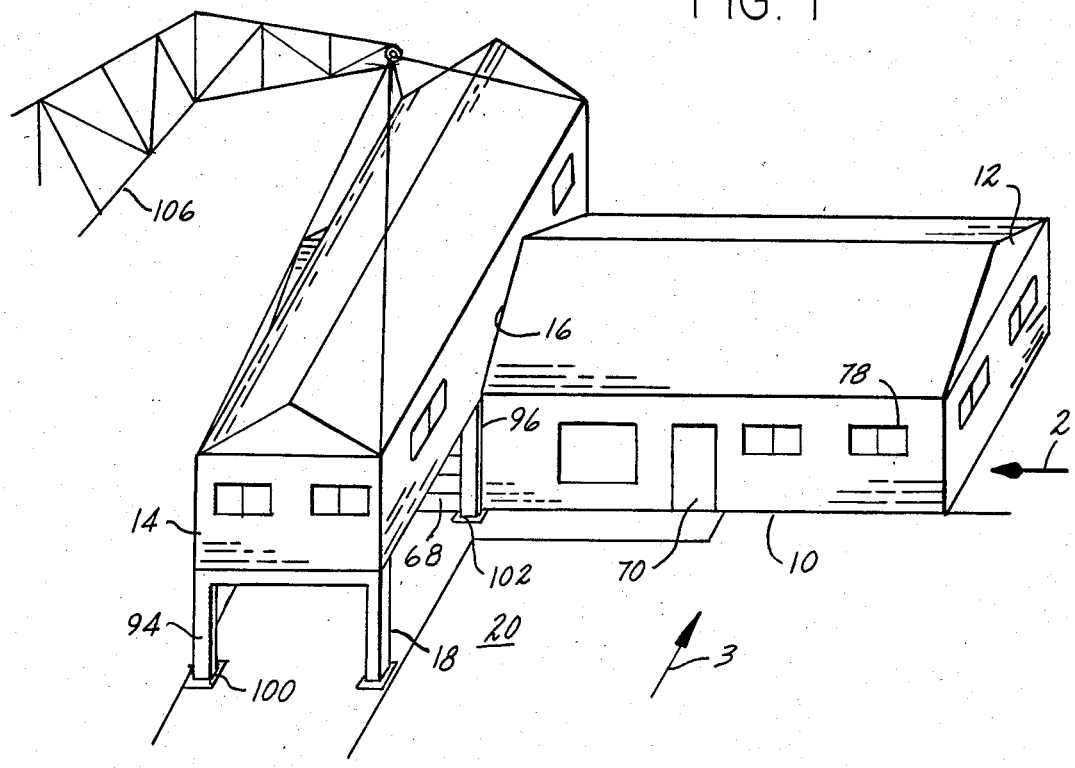
FIG. 1 is a perspective view of an expanded single story house structure constructed in accordance with the method of the invention.

As shown best in FIG. 1, a single story pre-existing house structure 10 having a peaked roof 12 is expanded by placing a later built prefabricated room sized dwelling unit 14 in an opening 16 in the roof structure 12 in the pre-existing single story house structure 10. The prefabricated dwelling unit 14 as shown in FIG. 1 is supported in position in the opening 16 in the roof structure 12 on separate support structure 18 extending between the ground 20 and the prefactricated dwelling unit 14.

In accordance with the method of the invention, the opening 16 is cut in the peaked roof structure 12 of the single story house structure 10. The later built, prefabricated dwelling unit 14 is constructed complete at the remote location such as a factory, is shipped to the site of the pre-existing house structure 10, the support structure 18 is constructed and the prefabricated dwelling unit 14 is lifted into position in the opening 16 in the roof structure 12 and is supported in such position by the support structure 18.

Figure 4:
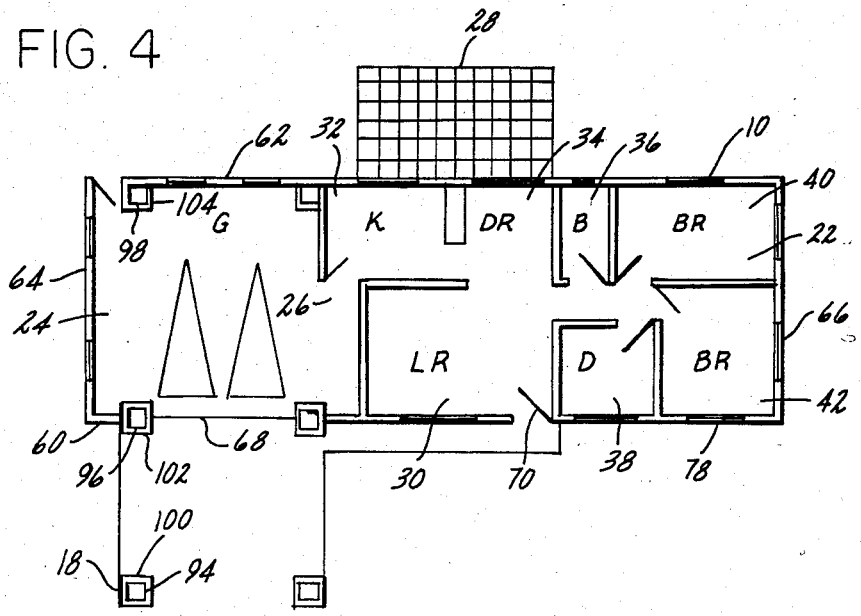
FIG. 4 is a plan view of the pre-existing single story house structure illustrated in FIG. 1 showing additional support members positioned in relation to the pre-existing single story house structure for supporting the later built prefabricated dwelling unit combined with the single story pre-existing house structure to effect expansion thereof in accordance with the invention.

More specifically, as shown better in FIG. 4, the pre-existing house structure 10 is a two or three bedroom house structure having an attached 2½ car garage 24 with an entry hall 26 between the garage 24 and living area 22 of the house structure 10 and a rear patio 28. As shown in FIG. 4, the living area 22 of the pre-existing house structure 10 includes the living room 30, kitchen 32, dining room 34, bath 36, den or bedroom 38 and bedrooms 40 and 42.

Figure 5:
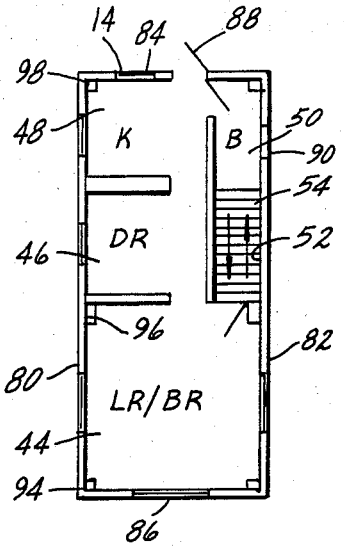
FIG. 5 is a plan view of the prefabricated later built dwelling unit utilized in expanding the single story house structure illustrated in FIG. 4 in accordance with the structure and method of the invention.
Figure 6:
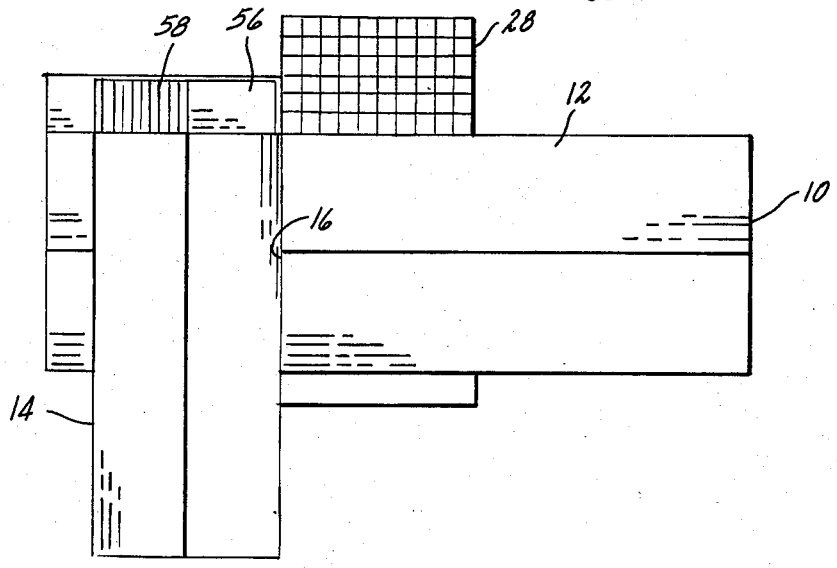
FIG. 6 is a plan view of the expanded pre-existing single story house structure with the prefabricated later built dwelling unit in combination therewith in accordance with the structure and method of the invention.

The prefabricated later constructed room sized dwelling unit 14 shown in plan view in FIG. 5 includes a living room, bedroom area 44, dining area 46, Kitchen area 48 and bath 50. Opening 52 is provided therein in which stairs 54 are constructed as shown in FIG. 6 to permit entrance to and egress from the prefabricated dwelling unit 14 from the pre-existing house structure 10. Also as shown best in FIG. 6 after assembly of the prefabricated dwelling unit 14 in the opening 16 in the roof structure 12 of the pre-existing house structure 10 porch structure 56 and stairs 58 may be provided to permit entrance to and egress from the prefabricated dwelling unit 14 from the exterior thereof.

As shown the pre-existing house structure 10 includes the parallel spaced apart front and rear bearing walls 60 and 62 and the left and right bearing walls 64 and 66 respectively. The usual garage door 68 entrance door 70 and windows 78 are provided in the pre-existing house structure 10.

The prefabricated later built room sized dwelling unit 14 includes the parallel spaced apart left and right side walls 80 and 82 and the parallel spaced apart back and front walls 84 and 86. Again the usual door and window structure 88 and 90 are provided in the prefabricated dwelling unit 14.

Figure 2:
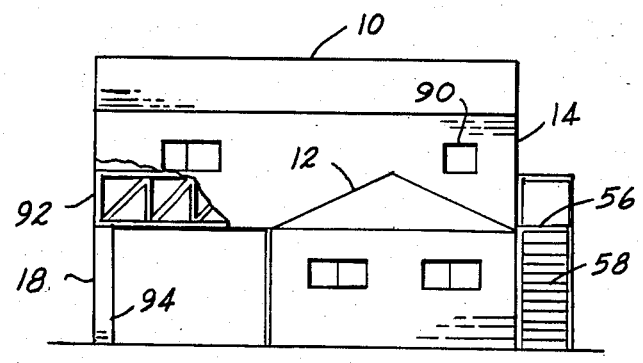
FIG. 2 is a side elevation of the expanded single story house structure of FIG. 1 taken substantially in the direction of arrow 2 in FIG. 1.
Figure 3:
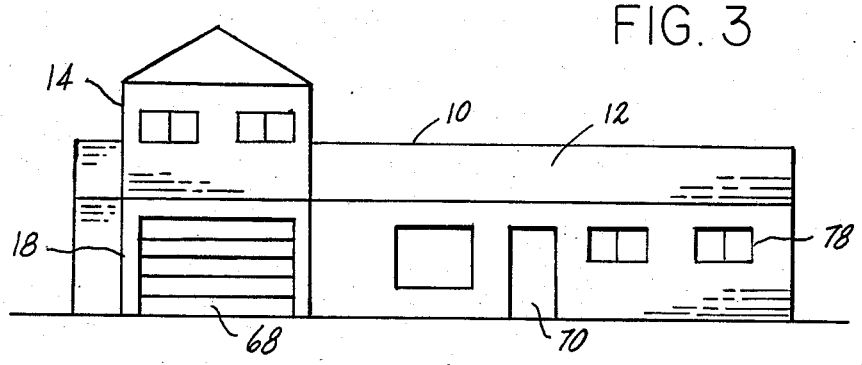
FIG. 3 is a front elevation of the expanded single story house structure of FIG. 1 taken in the direction of arrow 3 in FIG. 1.

Also in the prefabricated dwelling unit 14, the parallel spaced apart side walls 80 and 82 are provided with trusses 92 only one of which is shown in FIG. 2 extending over the lower half thereof and extending for the full length of the side walls 80 and 82. The trusses 92 are held in spaced apart parallel relation by the back and front walls 84 and 86 of the dwelling unit 14.

As shown in the embodiment of the invention illustrated in FIGS. 1–6 the prefabricated later built, room sized dwelling unit 14 is supported entirely on support structure 18 including stanchions 94, 96 and 98 which are supported from the ground 20 by suitable foundation structure 100, 102 and 104. As shown best in FIGS. 4–6, the stanchion 94 is positioned in spaced relation to the pre-existing house structure 10 while the stanchion 98 is positioned within the existing building structure 10 adjacent the bearing wall 62. The stanchion 96 is constructed within the bearing wall 60.

As indicated above, in the method of the invention, when it is decided to expand the pre-existing single story house structure 10, a later constructed prefabricated building unit 14 is manufactured preferably but not necessarily at a site remote from the pre-existing house structure 10 and is shipped to the site of the house structure 10. Exterior stanchion. 94 is constructed and then the opening 16 is cut in the roof of the pre-existing house structure 10 and the stanchions 96 and 98 are constructed within the bearing wall 60 and adjacent the bearing wall 62 as shown best in FIG. 6. The prefabricated later built room sized dwelling unit 14 is then lifted as by crane 106 into position in the opening 16 in the roof 12 of the pre-existing house structure 10 and is secured in the opening 16 and to the stanchions 94, 96 and 98. The stairs 54 and the porch 56 and stairs 58 may then be constructed to permit entry into and egress from the prefabricated building unit 14 from within the pre-existing house structure 10 and from the exterior thereof.

Again, the advantages of such structure for and method of expanding a single story pre-existing house structure 10 include the ability to obtain manufacturing efficiencies due to construction of the prefabricated dwelling unit 14 at a remote location, the ability to place the prefabricated dwelling unit 14 into place in the opening 16 in the roof structure 12 of the pre-existing house structure 10 as a single unit in view of the truss structure 92 extending the entire length of the spaced apart parallel sides 80 and 82 thereof and end walls 84 and 86 holding the side walls 80 and 82 including the trusses 92 therein in parallel spaced apart relation. Another extremely desirable advantage of the structure for expansion of an existing single story house structure as disclosed above is the ability to support the prefabricated dwelling unit entirely from the ground on stanchions whereby expansion of single story house structures is feasible in earthquake prone areas.

The method of the invention is particularly advantages in that again economies are realized by constructing the prefabricated building units 14 at a remote location rather than stick building the prefabricated dwelling unit piece by piece at the site of the pre-existing house structure 10. Also because the dwelling unit is set in place in the opening 16, rather than being built in the opening 16, the roof 12 of the pre-existing house structure 10 is opened for only a short time as for example one or two days.

While one embodiment of the present invention has been considered in detail above, it will be understood that other embodiments and modifications of the invention are contemplated.

Thus, the later built prefabricated room sized dwelling unit 14 may be supported entirely by the bearing 2alls 60 and 62 of the pre-existing house structure 10 through the trusses 92 or may be supported by any combination of the bearing walls 60 and 62 and additional supports 18 such as the stanchions 94, 96 and 98. Further, any other substitutes for the bearing wall may be utilized to support the prefabricated building unit 14 such as posts, beams, cross beams, and the like. Also, the supports 18 may be positioned as necessary either within or without the pre-existing house structure 10 and in fact as indicated above may be positioned entirely within the bearing walls 60 and 62 if desired for either esthetic or structural reasons.

Also, the prefabricated building unit 14 need not be constructed as a complete unit at a remote location, but may be constructed as a separate floor unit, wall units and a roof unit which may be separately shipped to the site of the pre-existng house structure 10 lifted into place separately and secured together to form the complete prefabricated dwelling unit 14. Also in this regard the roof structure, for example, can be constructed of separate trusses and roof panels, separately lifted into place and secured together at the pre-existing house structure site.

It is the intention to include all such embodiments and modifications as are defined by the appended claims within the scope of the invention.

We claim:

1. The method of expanding a pre-existing single story house structure having peaked roof structure to provide additional living space comprising cutting an opening in the roof of the pre-existing house structure, prefabricating a room sized dwelling unit, lifting the prefabricated room sized dwelling unit and positioning it in the opening in the peaked roof structure of the pre-existing house structure with a portion thereof extending outwardly away from the pre-existing house structure and supporting the prefabricated dwelling unit in position.

2. The method as set forth in claim 1, wherein the pre-existing house structure includes bearing walls and including supporting the prefabricated dwelling unit on the bearing walls.

3. The method as set forth in claim 1, and further including supporting the prefabricated dwelling unit from the ground independently of the pre-existing house structure.

4. The method as set forth in claim 3, wherein the pre-existing house structure includes bearing walls and further including supporting the prefabricated dwelling unit partly on the bearing walls of the pre-existing house structure and partly from the ground by separate support means.

5. The method as set forth in claim 3, and further including positioning the separate support means outside the pre-existing house structure.

6. The method as set forth in claim 3, and further including positioning the separate support means within the pre-existing house structure.

7. The method as set forth in claim 3, and further including the step of embedding the separate support means within pre-existing bearing walls in the pre-existing house structure.

8. The method as set forth in claim 1, wherein the prefabricated dwelling unit includes trusses extending the entire length of two spaced apart parallel side walls and further including the steps of supporting the prefabricated dwelling unit from the trusses and maintaining the trusses in parallel spaced apart relation.

9. the method of expanding a pre-existing building structure having roof structure to provide additional living space comprising cutting an opening in the roof of the pre-existing building structure, prefabricating a separate room sized unit, lifting the prefabricated room sized unit and positioning it in the opening in the roof structure of the pre-existing building structure with a portion thereof extending outwardly away from the pre-existing building structure and supporting the prefabricated unit in position.

* * * * *